US005199294A

United States Patent [19]

Murczek

[11] Patent Number: 5,199,294

[45] Date of Patent: Apr. 6, 1993

[54] BENDING TOOL FOR BENDING METAL SHEET

[76] Inventor: Travis H. Murczek, 1229 S. 57th Ave., Cicero, Ill. 60650

[21] Appl. No.: 811,694

[22] Filed: Dec. 20, 1991

[51] Int. Cl.[5] ..... B21D 5/16

[52] U.S. Cl. ..... 72/457; 72/477

[58] Field of Search ..... 72/319, 320, 321, 293, 72/379, 457, 458, 477, 479; 140/106

[56] References Cited

U.S. PATENT DOCUMENTS

| | | | |
|---|---|---|---|
| 438,413 | 10/1890 | Groves . | |
| 2,166,347 | 7/1939 | Farney . | |
| 2,222,081 | 11/1940 | Leigh . | |
| 2,579,171 | 12/1951 | Bien | 72/458 |
| 2,800,818 | 7/1957 | Larson . | |
| 2,818,757 | 1/1958 | Pille . | |
| 3,248,921 | 5/1966 | Trout | 72/458 |
| 3,848,454 | 11/1974 | Hall . | |
| 3,859,834 | 1/1975 | Riley | 72/319 |
| 4,148,205 | 4/1979 | Boysen . | |
| 4,163,381 | 8/1979 | Hodshon . | |
| 4,191,043 | 3/1980 | Schaffer | 72/458 |
| 4,934,175 | 6/1990 | Hensler . | |

OTHER PUBLICATIONS

"Metalworking Hand Tools", Malco Catalog, p. 9.

Photocopy of Malco Folding Tool, Catalog No. 12, Sec 7.

*Primary Examiner*—David Jones

*Attorney, Agent, or Firm*—McAndrews, Held & Malloy, Ltd.

[57] ABSTRACT

This invention discloses a hand tool for bending a flange along an edge of a metal sheet. The tool can bend flanges of selected widths up to a maximum width and does not require that the metal sheet be marked or scored. A bending slot is formed by spaced apart forming plates having parallel bending edges at the boundary of the bending slot and a spacer between the plates. The spacer includes abutment edges spaced apart from bending edges. The abutment edges contact an edge of a metal sheet in the bending slot positioning the bending edges adjacent to the metal sheet and parallel to the edge of the metal sheet. Width-gaging openings through a forming plate communicate with the bending slot at locations spaced apart along the direction of the bending edges. Each width-gaging opening has a boundary with identifiable locations at selected distances from the bending edges. By aligning the edge of a metal sheet with an identifiable location of the boundary of the width-gaging opening, flange may be formed having a width equal to the distance from the identifiable location to the bending edge.

2 Claims, 3 Drawing Sheets

FIG. 3
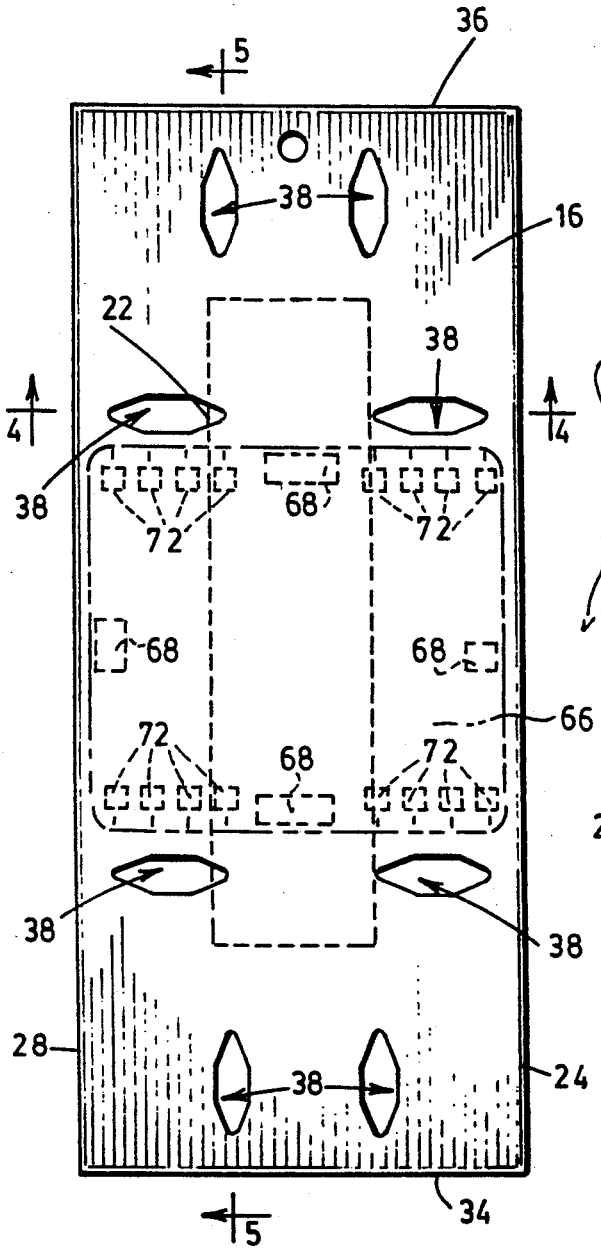
FIG. 1
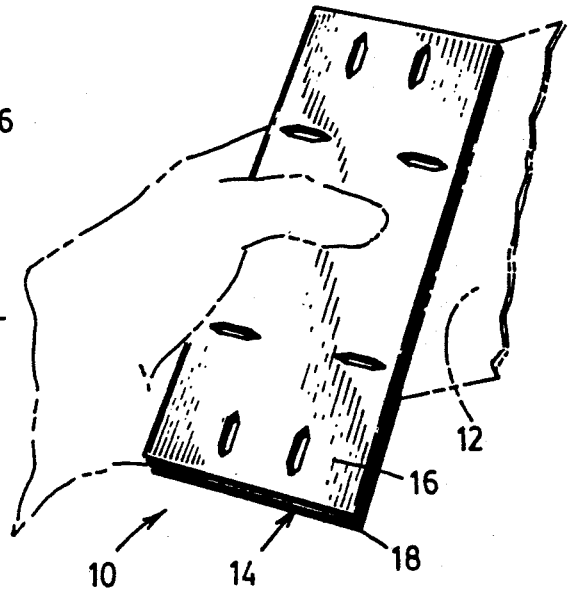
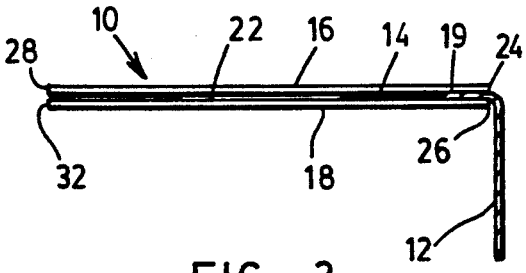
FIG. 2
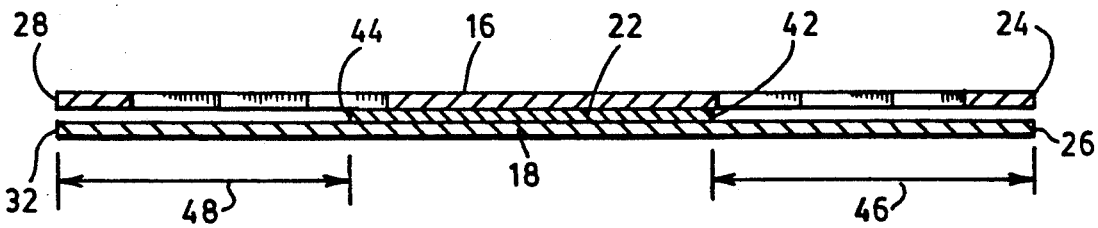
FIG. 4

BENDING TOOL FOR BENDING METAL SHEET

BACKGROUND OF THE INVENTION

The present invention relates to hand tools for forming a metal sheet, and more particularly, to a hand tool for bending a metal sheet along an edge to form a flange of a desired width.

Hand tools that are commonly used to bend a metal sheet to form a flange either engage the metal sheet to form a flange of a fixed width or require marking or scoring of the metal sheet to provide a guide for bending the flange. An example of the former is disclosed by U.S. Pat. No. 3,848,454 to Hall. Hall discloses a four sided tool having a bending slot on each side. Opposed bending plates are separated by a centrally positioned spacer plate that is smaller than the bending plates. The bending plates define the slots by extending from the spacer plate to edges at different distances from the spacer plate. The spacer plate forms the inner boundary of the slot. Flanges of two widths, equal to the distances from the spacer plate to the edges of the bending plates, may be formed by each bending slot by pivoting the tool about the edge of one of the bending plates. An example of a tool that requires marking of the metal sheet is disclosed by U.S. Pat. No. 4,934,175 to Hensler et al. Hensler et al. discloses a bending tool having spaced apart right angle members positioning parallel surfaces to form a slot. The metal sheet is positioned between the spaced apart surfaces at a desired location. A lever is mounted to the tool and a force is applied to the lever to rotate the tool bending the metal sheet.

A bending tool manufactured by Malco Products Co., Inc. provides two bending slots of different fixed depths and has openings into the bending slots. The tool is formed by two identically sized rectangular plates that are secured to each other. The plates are formed to diverge from each other at a selected distance from a side and a second selected distance along an opposed side. The plates extend in parallel spaced apart relation from the diverging location forming two bending slots of different depths along the opposed edges of the tool. Two openings extend through the plates at spaced apart locations along each bending slot. Straight sections of each opening boundary diverge continuously from a location at a selected distance from the edge of the plate to the location that the plates diverge to form the bending slot.

Neither type of bending tool is well suited to forming a flange at an edge of a metal sheet being is formed to closely overlie an irregular or irregularly sized surface. Aluminum sheet overlying facia, window trim, or door trim are examples of formed metal sheet that must be bent at various distances from an edge of a metal sheet Additionally, aluminum facia, window trim, and door trim must often be formed by hand in relatively inaccessible locations. Flanges of different widths and lengths are required and are most conveniently formed by a hand tool when the metal sheet is positioned adjacent to the surface it is being formed to overlie.

Conventional bending tools cannot form a flange within a range of widths without having to mark the metal sheet or determining the width of the flange in order to select an appropriate tool.

SUMMARY OF THE INVENTION

The present invention provides a hand tool that will bend a metal sheet near an edge to form a flange of a desired width within a range of widths. The improved tool of the present invention includes two flat forming plates, each having straight bending edges. The plates are parallel and spaced apart to form a sheet bending slot between the plates. Opposed boundaries of an opening of the sheet bending slot are formed by parallel spaced apart bending edges of the forming plates. An spacer is positioned between and secured to the forming plates. The spacer positions an abutment edge at a selected distance from a bending edge. The abutment edge is constructed to conform to an edge of a metal sheet in the sheet bending slot and position the bending edges in parallel relation to the edge of the metal sheet. Two width-gaging openings are formed through one of the forming plates to the bending slot at spaced apart locations along the direction of the bending edge.

The openings have a boundary with identifiable locations at selected distances from the bending edge. A flange having a width that is equal to the distance from the bending edge to the abutment edge may be formed by positioning the tool engaging the metal sheet in the bending slot with the edge contacting the abutment edge and rotating the tool about a bending edge adjacent to the metal sheet. Further, a flange having a width that is one of the selected distances is formed at and edge of a metal sheet by positioning the edge of the metal sheet in the bending slot adjacent to a location at the desired selected distance from the edge of each opening and rotating the tool about the bending edge.

Accordingly, it is an object of the present invention to provide a tool for bending a metal sheet to form a flange along an edge of the metal sheet of a selected width up to a maximum width that does not require that the metal sheet be marked or scored.

Another object of the present invention is to provide a tool for bending a metal sheet to form a flange along an edge of the metal sheet that can be carried and manipulated to form a flange at an edge of a metal sheet by one hand.

A further object of the present invention is to provide a tool for bending a metal sheet that will form a flange at a desired angle with respect to the metal sheet.

It is yet another object of the present invention to provide a tool for bending a metal sheet that has two parallel spaced apart forming plates that define a bending slot between the plates, each having a bending edge to define parallel boundaries of an opening to the bending slot, a spacer positioned between the forming plates that has an abutment edge that is parallel to and spaced from the bending edges, and one of the forming plates has openings spaced apart along the direction of bending edge that communicate with the bending slot and have boundaries with identifiable locations at selected distances from the bending edge.

These and other objects and advantages of the present invention, as well as details of the preferred embodiment thereof, will be more fully understood from the following description and the drawings.

BRIEF DESCRIPTION OF THE DRAWINGS

My preferred embodiment is shown in the drawings wherein:

FIG. 1 is a perspective view of a bending tool according to the present invention bending a flange at an edge of a metal sheet.

FIG. 2 is a side view of the bending tool shown by FIG. 1 engaging a metal sheet after bending a flange at an edge.

FIG. 3 is a top view of the bending tool shown by FIG. 1.

FIG. 4 is a view of the section 4—4 of FIG. 3.

Figure 6:
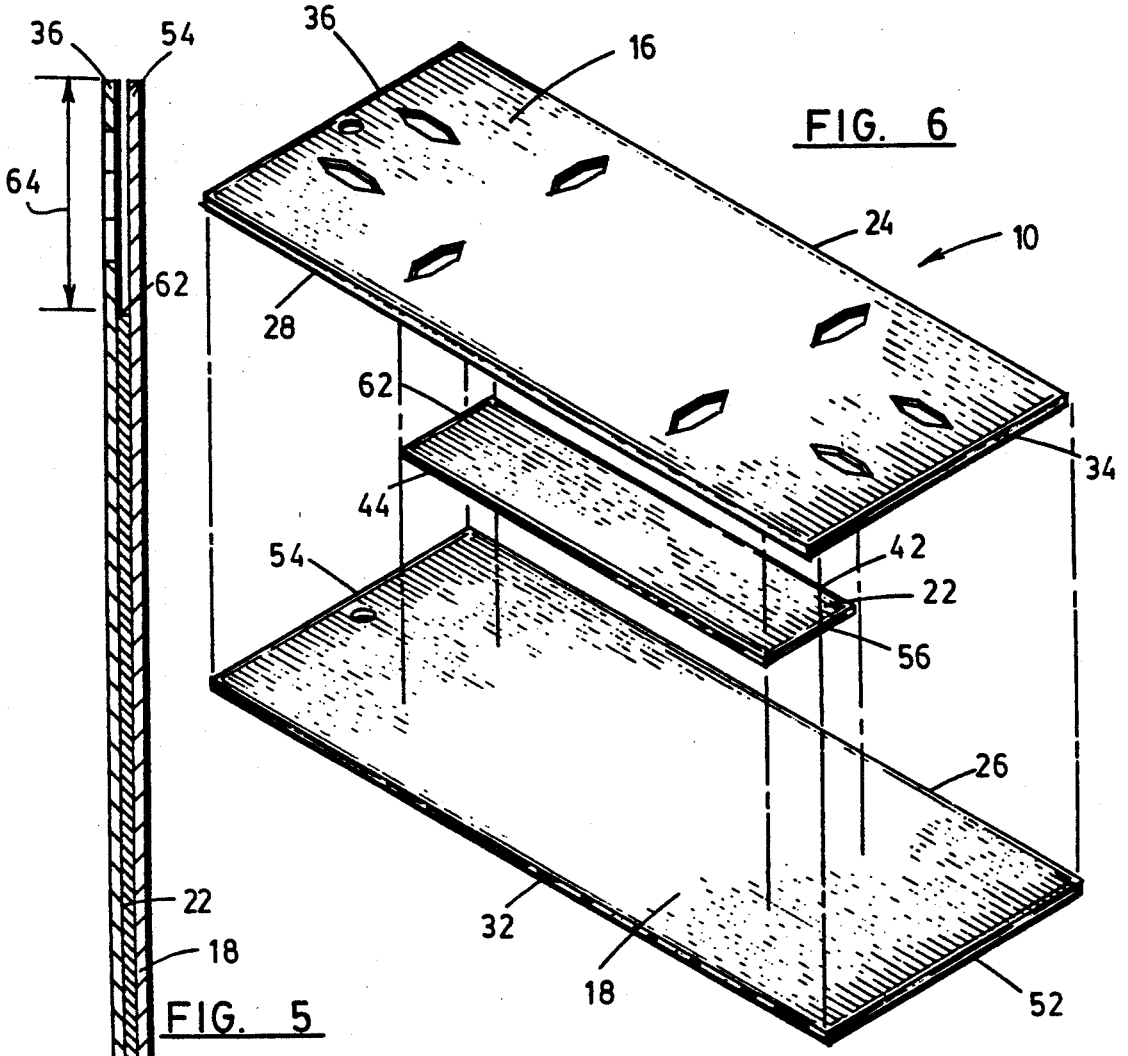
FIG. 6 is a perspective exploded view of the bending tool shown by FIG. 1.

In the following detailed description, spatially orienting terms are used such as "left," "right," "upward," "downward," and the like. It is to be understood that these terms are used for convenience of description of the preferred embodiments by reference to the drawings; unless so specified, these terms do not necessarily describe the absolute location in space, such as left, right, upward, downward, etc., that any part must assume.

DETAILED DESCRIPTION OF THE INVENTION

FIGS. and 2 show a bending tool 10 according to the present invention engaging and forming a flange at an edge of a metal sheet 12. FIG. 1 shows the metal sheet 12 in phantom engaging bending slot 14 of the bending tool 10. The bending tool 10 is a hand tool used by grasping the tool as shown in phantom in FIG. The bending slot 14 of the bending tool 10 is formed by a cover forming plate 16, a base forming plate 18 that is parallel to and spaced apart from the cover forming plate 16, and a flat spacer 22 that is secured between and separates forming plates 16 and 18. As best shown by FIG. 2, the metal sheet 12 extends into the bending slot 14 and may be bent along a bending edge of a forming plate such as edge 26 at the boundary of the base forming plate 18 forming a flange 19. The cover forming plate 16 has bending edges 24 and 28 on opposed boundaries. The base forming plate 18 has bending edges 26 and 32 on opposed boundaries that are parallel and adjacent to bending edges 24 and 28, respectively. The bending tool 10 may be used to form the flange 19 at any desired angle from nearly coplanar with, to nearly overlying the metal sheet 12 adjacent to the flange 19.

The cover forming plate 16 is rectangular and bounded by opposed bending edges 34 and 36 and the bending edges 24 and 28, as best shown by FIG. 3. The spacer 22 is rectangular and is bounded by abutment edges that are parallel to and spaced apart from the bending edges of the cover forming plate 16. As shown by FIG. 3, the spacer 22 is positioned so that an abutment edge forms a boundary of the bending slot 14 parallel to bending edges of the forming plates. Two width-gaging openings 38 in the cover forming plate 16 communicate with the bending slot 14 at spaced apart locations along the direction of each bending edge. The width-gaging openings 38 are located between the bending edge and the spacer 22.

Figure 5:
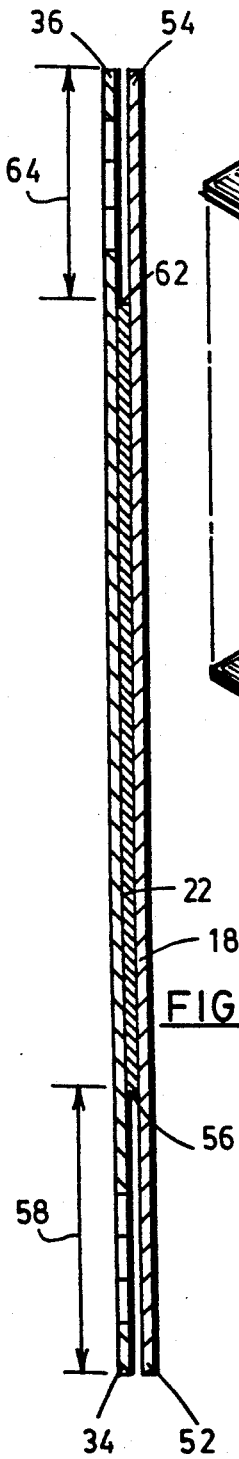
FIG. 5 is a view of the section 5—5 of FIG. 3.

As shown in FIG. 4, an abutment edge 42 of the spacer 22 is parallel to and spaced apart from the bending edges 24 and 26 by a first slot depth 46. An abutment edge 44 is parallel to and spaced apart from bending edges 28 and 32 by a second slot depth 48. As best shown by FIG. 5, base forming plate 18 has bending edges 52 and 54 that are parallel to and spaced apart from bending edges 34 and 36, respectively. An abutment edge 56 of the spacer 22 is parallel to and spaced apart from bending edges 52 and 34 by a third slot depth 58. An abutment edge 62 of the spacer 22 is parallel to and spaced apart from bending edges 36 and 54 by a fourth slot depth 64.

A rectangular label 66, shown in phantom in FIG. 3, has a width marking 68 at a location on label 66 near each of the bending edges 24, 28, 34, and 36 of the cover forming plate 16. The width markings 68 indicate the slot depths from the bending edges adjacent the width marking to the nearest abutment edge of the spacer 22. In addition, gage markings 72 are adjacent to edges of the label 66 that are parallel to bending edges 34 and 36. The gage markings 72 are positioned adjacent to width-gauging openings 38 that are spaced apart along bending edges 24 and 28. The gage markings 72 indicate the distance from the nearest bending edge, 24 or 28, to the location of the depth marking.

The width-gaging openings 38 are formed having boundaries that extend from a location a first width from the adjacent bending edge toward the spacer 22. The width-gaging openings 38 are configured to have easily identified locations at selected distances between the first width and the farthest extent of the width-gaging opening from the adjacent bending edge. The first width and selected distances are indicated by the depth markings 72 adjacent to the width-gaging openings 38 along bending edges 24 and 28.

FIG. 6 shows an exploded view of the bending tool 10 according to the present invention. The spacer 22 is positioned between base forming plate 18 and cover forming plate 16. The spacer 22 separates the forming plates 16 and 18 by the thickness of spacer 22 defining the width of bending slot 14.

As presently preferred, the forming plates 16 and 18 are rectangular plates having bending edges 34, 36, 52, and 54 three inches in length and bending edges 24, 26, 28, and 32 seven inches in length. The bending tool 10 is constructed to form a flange in a sheet of aluminum approximately 0.019 inches thick. The forming plates 16 and 18 are 0.062 inches thick and are steel. The spacer 22 is steel and is sized and positioned so that slot depth 58 is one and one-half inches, slot depth 64 is one and one quarter inches, slot depth 46 is one inch, and slot depth 48 is seven eighths of an inch. The thickness of the spacer 22 is 0.062 inches. The spacer 22 is secured to the forming plates by spot welding.

Figure 7:
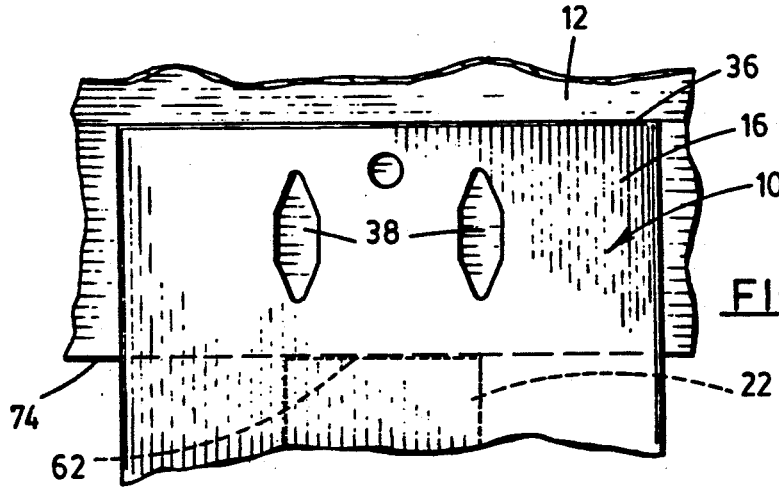
FIG. 7 is a top view of a section of the bending tool shown by FIG. 1 and a section of a metal sheet in the bending slot contacting the spacer.

FIG. 7 shows a section of a metal sheet 12 positioned within the bending slot 14 with an edge 74 contacting abutment edge 62 of the spacer 22. The bending edge 36 is parallel to the edge 74 of the metal sheet 12. The bending tool 10 can be used to bend a flange of width equal to fourth slot depth 64 by rotating the bending tool about either bending edges 36 or 54. As shown by FIG. 7, the bending edge 36 extends along a section of the edge 74 of the metal sheet 12. A flange may be bent along a length of the metal sheet by displacing the bending tool 10 along the metal sheet edge 74 to a position adjacent to that shown by FIG. 7, and rotating the bending tool about a bending edge.

Figure 8:
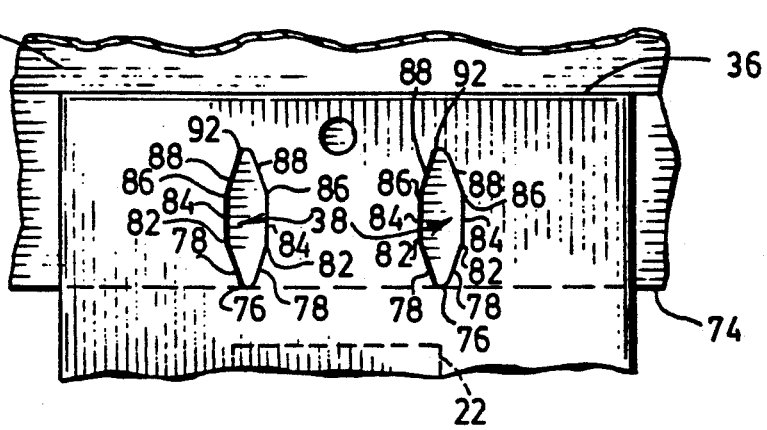
FIG. 8 is a top view of a section of the bending tool shown by FIG. 1 and a section of a metal sheet having an edge in the bending slot adjacent to the width-gaging openings.

FIG. 8 shows a section of the metal sheet 12 extending into the bending slot 14. The bending tool 10 is positioned engaging the metal sheet 12 in the bending slot 14 with the bending edge 36 parallel to edge 74 at a distance less than the fourth slot depth from the edge 74. The bending tool may be accurately positioned so that the edge 74 of the metal sheet 12 is a selected distance from the bending edge 36 by positioning the edge 74 adjacent to the width-gaging openings 38 at the farthest extent of the opening 38 from the bending edge 36.

As shown by FIG. 8, the width-gaging openings 38 are hexagonal openings having vertices at four selected distances from the bending edge 36. The farthest extent of the width-gaging opening 38 from a bending edge 26 is a vertex 76. Two boundary segments 78 extend from the vertex 76 toward the bending edge 36 and away from each other to vertices 82 at a second selected distance from the bending edge 36. Boundary segments 84 extend from the vertices 82 toward the bending edge 36 and parallel to each other to vertices 86. The boundary segments 88 extend from the vertices 86 toward the bending edge 36 to meet at vertex 92, the closest extent of the width-gagings, openings 38 to the bending edge 36.

As best shown by FIG. 3, two width-gaging openings 38 are positioned at spaced apart locations along each bending edge of cover forming plate 16. Each width-gaging opening is identically sized, configured, and positioned with respect to the adjacent bending edge. That is, the distance from a bending edge to a vertex 92 closest to the bending edge is the same adjacent to each bending edge 24, 28, 34, and 36. The bending tool 10 may be used to bend a flange at an edge of a metal sheet 12 of a width equal to the distance from a bending edge to a vertex 92, 86, 82, or 76 by positioning the edge 74 of the metal sheet 12 within the bending slot 14 adjacent to a bending edge and aligning the vertices at the desired distance from the bending edge with the edge 74 of the metal sheet 12. In addition, by positioning the spacer 22 so that the distance from an abutment edge of the spacer 22 to the nearest bending edge is different for each abutment edge, flanges of widths equal to the distances from the abutment edges to the bonding edges may be made with the bending tool without requiring alignment of the edge of a metal sheet with vertices of width-gaging openings 38.

Figure 9:
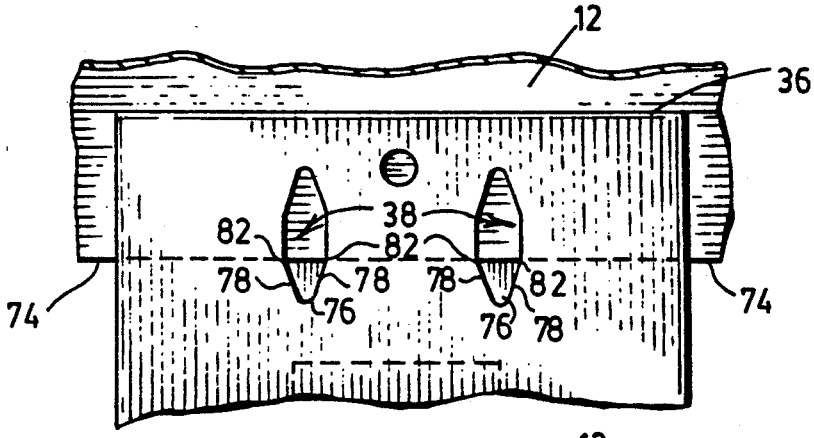
FIG. 9 is a top view of a section of the bending tool shown by FIG. 1 and a section of a metal sheet having an edge in the bending slot adjacent to the width-gaging openings.
Figure 10:
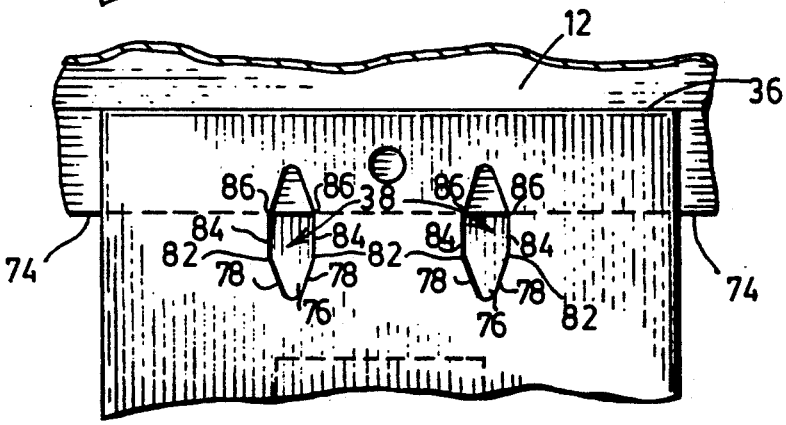
FIG. 10 is a top view of an edge of the bending tool shown by FIG. 1 and a section of a metal sheet having an edge in the bending slot adjacent to the width-gaging openings.
Figure 11:
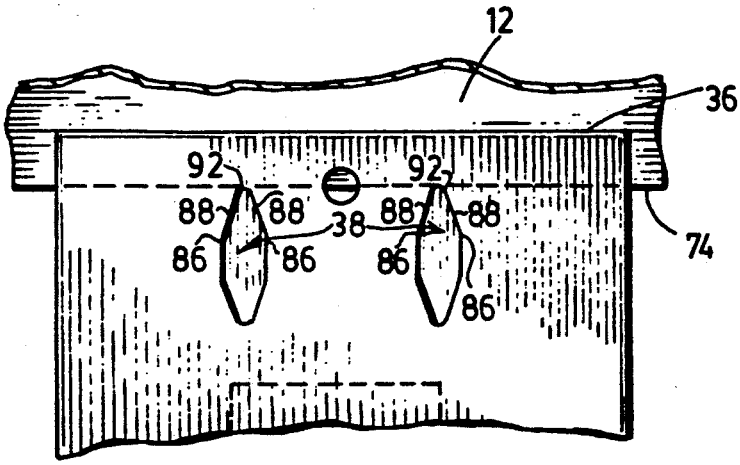
FIG. 11 is a top view of an edge of the bending tool shown by FIG. 1 and a section of a metal sheet having an edge in the bending slot adjacent to the width-gaging openings.

As shown by FIG. 8, positioning the edge 74 of the metal sheet 12 adjacent to vertices 76 of both width-gaging openings 38 along the bending edge 36, positions the bending edge 36 parallel to the edge 74. FIG. 9 illustrates a section of the metal sheet 12 positioned within the bending slot 14 with the edge 74 positioned adjacent to the vertices 82 of both width-gaging openings 38. The edge 74 of the metal sheet 12 is positioned parallel to the bending edge 36 at a distance equal to the distance from the vertices 82 to the bending edge 36. FIG. 10 illustrates a section of the metal sheet 12 positioned in the bending slot 14 with the edge 74 positioned adjacent to vertices 86 of both width-gaging openings 38. FIG. 11 illustrates metal sheet 12 positioned within the bending slot 14 with edge 74 adjacent to vertices 92 of both width-gaging openings 38.

The width-gaging openings 38 are sized and positioned so that vertex 92 is one quarter inch from the adjacent bending edge, vertices 86 are one-half inch from the adjacent bending edge, vertices 78 are three quarters of an inch from the adjacent bending edge, and vertex 76 is one inch from the adjacent bending edge. Two width-gaging openings 38 are symmetrically spaced with respect to the midpoint of each cover bending edge 24, 28, 34 and 36. The centers of width-gaging openings adjacent to bending edges 24 and 28 are three inches apart and the centers of width-gaging openings adjacent to bending edges 34 and 36 are one inch apart.

A flange of width equal to the distances from a bending edge to a vertex of a width-gaging opening 38 or a slot depth may be formed by positioning the tool as described above and rotating the tool about a bending edge adjacent to the metal sheet. When a flange of width equal to one quarter inch, one half inch, or three quarters inch is desired, all cover bending edges, 24, 26, 28, 32, 34, 36, 52, and 54 may be used to form the flange. When a one inch flange is required, bending edges 34, 36, 52 and 54 may be used by aligning an edge of the metal sheet with vertices 76 of width-gaging openings adjacent to bending edges 34 or 36. Additionally, a one inch flange may be formed by abutting an edge of the metal sheet against abutment edge 42 and rotating the bending tool 10 about either of bending edges 24 or 26. A flange one and one quarter inches wide may be formed by abutting an edge of the metal sheet against abutment edge 62 and rotating the bending tool 10 about either of bending edges 36 or 54. A flange one and one half inches wide maybe formed by abutting an edge of the metal sheet against abutment edge 56 and rotating bending tool 10 about either of bending edges 34 or 52. A flange seven eighths of an inch wide may be formed by abutting an edge of a metal sheet against abutment edge 44 and rotating hand tool 10 about either of bending edges 28 or 32.

Flanges may be formed along an edge of a metal sheet that is much longer than any bending edge of bending tool 10 in a conventional manner by positioning the tool as described above, rotating about a bending edge, and moving the tool along the edge of the metal sheet to a position adjacent to the formed section of the flange to form an adjacent flange section.

The foregoing is a description of the preferred embodiment. It will be understood that the invention is not limited to the described embodiment since modifications may be made by those skilled in the art, particularly in view of the foregoing teachings. The scope of this invention is determined, however, by reference to the following claims.

I claim:

1. An improved tool for forming a flange at an edge of a sheet of metal comprising:

a base forming plate having a base bending edge and a second base bending edge;

a cover forming plate having a cover bending edge and a second cover bending edge, the cover forming plate and the base forming plate positioned in spaced apart relation with the base bending edge and the cover bending edge in parallel spaced apart relation and the second base bending edge and the second cover bending edge in parallel spaced apart relation;

the base forming plate and the cover forming plate defining a bending slot therebetween having an opening bounded by the bending edges;

a spacer positioned in the bending slot, constructed to abut an edge of the sheet of metal positioned in the bending slot at a slot depth from the bending edges and to position the bending edges in parallel relation to the edge of the metal sheet, and constructed to abut the edge of the sheet of metal positioned in the bending slot at a second slot depth from the second bending edges and to position the second bending edges in parallel relation to the edge of the metal sheet;

the cover forming plate having two width-gaging openings formed through the cover forming plate at spaced apart locations along the direction of the cover bending edge adjacent to the bending edge and communicating with the bending slot and further having two width-gaging openings formed through the cover forming plate at spaced apart locations along the direction of the second cover bending edge adjacent to the second bending edge and communicating with the bending slot; and each width-engaging opening adjacent to one of the cover bending edges being defined by a boundary having two straight first sides, each extending away from the adjacent bending edge from a first vertex spaced from the bending edge to meet a straight second side at a second vertex, each second side extending away from the adjacent bending edge perpendicular to the bending edge to meet a straight third side at a third vertex, the third sides extending away from the adjacent bending edge toward each other to meet at a fourth vertex spaced apart from the first vertex in a direction generally perpendicularly away from the adjacent bending edge whereby the vertices of the width-gaging opening provide identifiable locations at distances from the adjacent bending edge that are less than the slot depth and the bending tool is thereby constructed to form a flange at the edge of the sheet of metal of width equal to the slot depth, the second slot depth, or a distance from a bending edge to an identifiable location on the boundary of adjacent width-gaging openings.

2. An improved tool for forming a flange at an edge of a sheet of metal comprising:

a rectangular base forming plate having a boundary defining four base bending edges;

a rectangular cover forming plate having a boundary defining four cover bending edges, the cover forming plate and the base forming plate positioned in spaced apart relation with the base bending edges and the cover bending edges in parallel spaced apart relation;

the base forming plate and the cover forming plate defining a bending slot therebetween bounded by the bending edges;

a rectangular spacer bounded by four abutment edges, positioned in the bending slot, and sized to position each abutment edge parallel to and spaced apart from one of the cover bending edges in the bending slot at selected slot depths from the cover bending edges, the abutment edges constructed to abut an edge of a metal sheet positioned in the bending slot at one of the slot depths and position the bending edges parallel to the edge of the metal sheet in parallel relation to the edge of the metal sheet;

the cover forming plate having two width-gaging openings formed through the cover forming plate adjacent to and at spaced apart locations along the direction of each cover bending edge and communicating with the bending slot; and each width-gaging opening being defined by a boundary having two straight first sides, each extending away from the adjacent bending edge from a first vertex spaced from the adjacent bending edge to meet a straight second side at a second vertex, each second side extending away from the bending edge in a direction perpendicular to the bending edge to meet a straight third side at a third vertex, the third sides extending away from the bending edge toward each other to meet at a fourth vertex spaced apart from the first vertex in a direction generally perpendicularly away from the bending edge whereby the vertices of the width-gaging openings provide identifiable locations at distances from the bending edges that are less than the slot depths and the bending tool is constructed to form a flange at the edge of the sheet of metal of width equal to a slot depth or a distance from a bending edge to an identifiable location on the boundary of adjacent width-gaging openings.

* * * * *